US005477702A

United States Patent [19]

Kennedy et al.

[11] Patent Number: 5,477,702

[45] Date of Patent: Dec. 26, 1995

[54] REFRIGERATED DISPLAY CABINET

[75] Inventors: Craig L. Kennedy; Barry R. A. Stent, both of Queensland, Australia

[73] Assignee: Noble Australia Pty. Ltd., Queensland, Australia

[21] Appl. No.: 230,784

[22] Filed: Apr. 21, 1994

[30] Foreign Application Priority Data

| | | | |
|---|---|---|---|
| Jan. 24, 1993 | [AU] | Australia | PM3559 |
| Apr. 21, 1993 | [AU] | Australia | PL8420 |
| Sep. 3, 1993 | [AU] | Australia | PM1006 |

[51] Int. Cl.[6] ..... A47F 3/04

[52] U.S. Cl. ..... 62/256; 62/258

[58] Field of Search ..... 62/255, 256, 258

[56] References Cited

U.S. PATENT DOCUMENTS

| | | | |
|---|---|---|---|
| 2,513,675 | 7/1950 | Quillen | 62/256 |
| 2,669,851 | 2/1954 | Pichler | 62/258 X |
| 3,009,333 | 11/1961 | Rainwater | 62/256 |
| 4,572,598 | 2/1986 | Moore, Jr. | 62/246 X |
| 4,685,311 | 8/1987 | Rastelli | 62/258 |
| 4,802,340 | 2/1989 | Johnson | 62/258 X |
| 5,168,719 | 12/1992 | Branz et al. | 62/256 X |
| 5,182,924 | 2/1993 | Trulaske, Sr. | 62/258 X |
| 5,191,769 | 3/1993 | Mangini et al. | 62/258 |
| 5,269,203 | 11/1993 | Engel et al. | 62/291 X |
| 5,282,367 | 2/1994 | Moore et al. | 62/256 |

*Primary Examiner*—William E. Tapolcai
*Attorney, Agent, or Firm*—Hoffman, Wasson & Gitler

[57] ABSTRACT

A refrigerated cabinet for preserving and displaying foodstuffs, the cabinet supporting rows of trays which carry the foodstuffs an providing a cool air flow both over the trays and under the trays to cool the foodstuffs from above and directly cool the trays. The cabinet may also include an overhead duct through which cool air flows to create an air curtain over the trays.

30 Claims, 6 Drawing Sheets

REFRIGERATED DISPLAY CABINET

TECHNICAL FIELD

This invention relates to a method and means for chilling which may be embodied in a refrigerated cabinet or unit and in particular in a refrigerated display cabinet of the type for displaying fresh foods in a restaurant or retail environment. The present invention also relates to a method and means for draining refrigerated cabinets or units.

BACKGROUND ART

It has become common place for restaurants, shops or other food outlets to provide refrigerated cabinets in which foods to be consumed such as salads, fruit or meat are displayed for selection either by patrons or shoppers. For preserving such foodstuffs the refrigerated cabinets usually employ some means for maintaining the containers for the foodstuffs at a low temperature so as to prevent their deterioration. Generally, however, the refrigerated cabinets which have been proposed in the past have not proved particularly efficient so that the foodstuffs stored and displayed are not sufficiently protected from deterioration. Additionally, some of the refrigerated cabinets often do not satisfy health authority requirements.

In the above type of cabinets, usually a considerable amount of condensation occurs and drains are provided to drain the condensed water into a tray provided with a heating element so that the water is evaporated. Often however the drain also directs spilt food into the tray which, when subject to heating from the heating element, deteriorates and creates a hygiene problem. Difficulties in flushing and cleaning cabinets of the above type also occur. A further disadvantage arises because the drain also tends to direct warm air back to the chilling part of the cabinet which reduces the chilling efficiency.

SUMMARY OF THE INVENTION

The present invention aims to overcome or alleviate the above disadvantages by providing a method and means for chilling or cooling for the purposes principally of preserving foodstuffs from deterioration. The method and means of the present invention in a particular aspect may be incorporated in a refrigerated cabinet or unit which ensures that food or other product stored and displayed therein is protected against deterioration. The present invention also aims in a preferred aspect to provide a unit in which the displayed food or product is readily accessible to consumers. The present invention in yet a further preferred aspect aims to provide a refrigerated cabinet or unit having means which allow for effective draining of condensed moisture and additionally enables more rapid cleaning and flushing. The present invention in a further preferred aspect aims to provide a unit incorporating a drainage system which prevents warm air being directed back to the chilling part of the cabinet so that the chilling efficiency of the cabinet remains substantially unaffected by the drainage system. Other objects and advantages of the invention will become apparent from the following description.

The present invention thus provides in a first preferred aspect a refrigerated unit including supporting means for supporting foodstuffs or other products, means for establishing a first cool air flow above said supporting means from one side of said supporting means to the other side thereof to cool said foodstuffs or other products from above and means for establishing a second cool air flow on the underside of said supporting means whereby said supporting means is directly cooled by said second cool air flow.

Preferably the unit includes first air outlet means on the one side of the supporting means through which cool air for the first cool air flow passes and air inlet means on the other side of the supporting means for receiving air from the first air outlet means. Preferably also the unit includes second air outlet means disposed below the first air outlet means for directing the second cool air flow to the underside of the supporting means. Alternatively, the first and second air outlet means may be combined.

The unit also includes air cooling means and circulating means for drawing air through the air cooling means and forcing the cooled air through the air outlet means. The air cooling means is suitably arranged within a passage below the supporting means, the passage having a first end adjacent the air inlet means and a second end adjacent the circulating means such that air from the air inlet means is drawn through the air cooling means by the circulating means.

The second cool air flow suitably passes above the passage from the second air outlet means towards the first end of the passage such that air from the second cool air flow is drawn into the passage and through the air cooling means.

The circulating means suitably comprise one or more fans and the air cooling means suitably comprise refrigeration coils. The refrigeration coils are suitably associated with a refrigeration unit located in the base of the cabinet.

In one particularly preferred arrangement, means for establishing a further cool air flow are provided, being arranged above the supporting means to direct a cool air flow downwardly towards the air inlet means and thereby create an air curtain over the supporting means. Duct means are suitably disposed above the supporting means and include outlet means through which the further cool air flow may pass downwardly toward the air inlet means. Preferably the supporting means are provided in rows on opposite sides of the duct means.

Suitably, the duct means comprises an elongated overhead duct having a plurality of outlets through which air may flow. The duct is preferably supported at each end by further upright ducts which provide communication with a cold air source. The upright ducts are suitably connected to a generally horizontal duct or channel extending longitudinally between the rows of supporting means. The horizontal duct includes the aforesaid air outlet means which are suitably in the form of slots or alternative apertures through which the first and second cool air flows are established.

A canopy may be supported over the overhead duct to extend on opposite sides thereof. If desired lighting elements may be provided on opposite sides of the overhead duct to illuminate the foodstuff supporting means.

The supporting means for the foodstuffs are preferably in the form of a single level of detachable open topped trays or pans or other similar shallow containers which are supported in a generally horizontal attitude. The trays are thus directly cooled from underneath by the second cold air flow whilst the first cold air flow passes over the top of the trays to further enhance the cooling effect on foodstuffs within the trays and thereby isolate the trays from the temperature of the outside atmosphere.

The fan or fans also preferably circulate cool air through the central overhead duct and for this purpose are suitably located adjacent the lower end of the upright ducts. The upright support ducts for the overhead duct may also be provided with air outlets for directing cool air downwardly and outwardly to the ends of the unit which may also include air inlets to draw in the air for cooling.

In an alternative configuration the further air flow establishing means may be provided on one side only of the unit to create a curtain of air on one side, such as from the rear of the cabinet downwardly over the supporting means such as trays for foodstuffs. In this arrangement only one row of trays may be provided. In an alternative configuration further or alternative ducts may be provided to extend at least part way around the perimeter of the cabinet at an elevated position, the ducts having air outlets to create an air curtain to the air inlets about the foodstuff supporting means.

The present invention provides in a further preferred aspect a refrigerated unit having a base and drain means for draining liquid or other materials from the base and seal means within the drain means permitting liquid and other materials to pass through the drain means but preventing the passage of air through the drain means. Most preferably, the drain means drains liquid or other materials into a holding tank which may be provided with an outlet which extends to a position externally of the unit so as to permit drainage of the tank to waste. Preferably, the outlet is provided with a removable cap which is externally accessible and which may be removed to permit liquid and other materials to be drained into say a bucket or the like.

Preferably, the seal means comprises a liquid seal and for this purpose, the drain means preferably incorporates a trap containing liquid which acts as a seal. The liquid in the trap thus permits drain liquids to pass to waste or to the holding tank but acts as a seal to prevent hot air passing back through the drain means which would reduce the chilling efficiency. The trap suitably is in the form of a P-trap.

Alternatively, the drain means may drain directly through the liquid seal to an external waste such as a floor waste in the vicinity of the cabinet.

In yet a further aspect, the present invention provides a method of cooling foodstuffs or other products held in an open topped container, said method including the steps of establishing a first cool air flow above said container from one side of said container to the outer side thereof to cool said foodstuffs or other products from above and establishing a second cool air flow on the underside of said container whereby said container is directly cooled by said second cool air flow.

Suitably, the first and second cool air flows are in the same direction above and below the container.

BRIEF DESCRIPTION OF THE DRAWINGS

In order that the invention may be more readily understood and put into practical effect, reference will now be made to the accompanying drawings which illustrate a preferred embodiment of the invention and wherein.

DETAILED DESCRIPTION OF THE EMBODIMENTS

Figure 1:
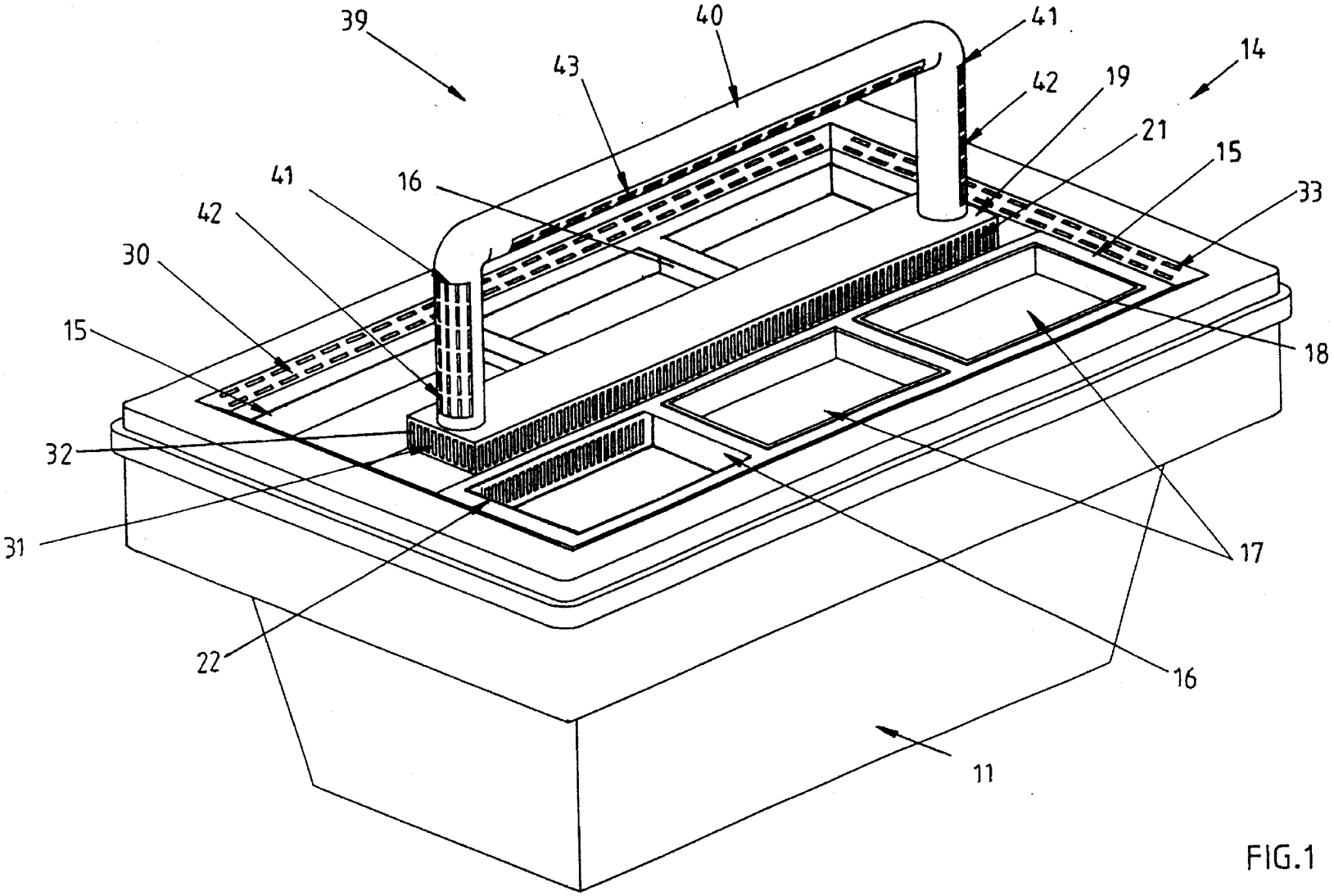
FIG. 1 is a perspective view of a first form of display and cooling unit of a refrigerated cabinet according to the invention with one foodstuff tray removed.
Figure 2:
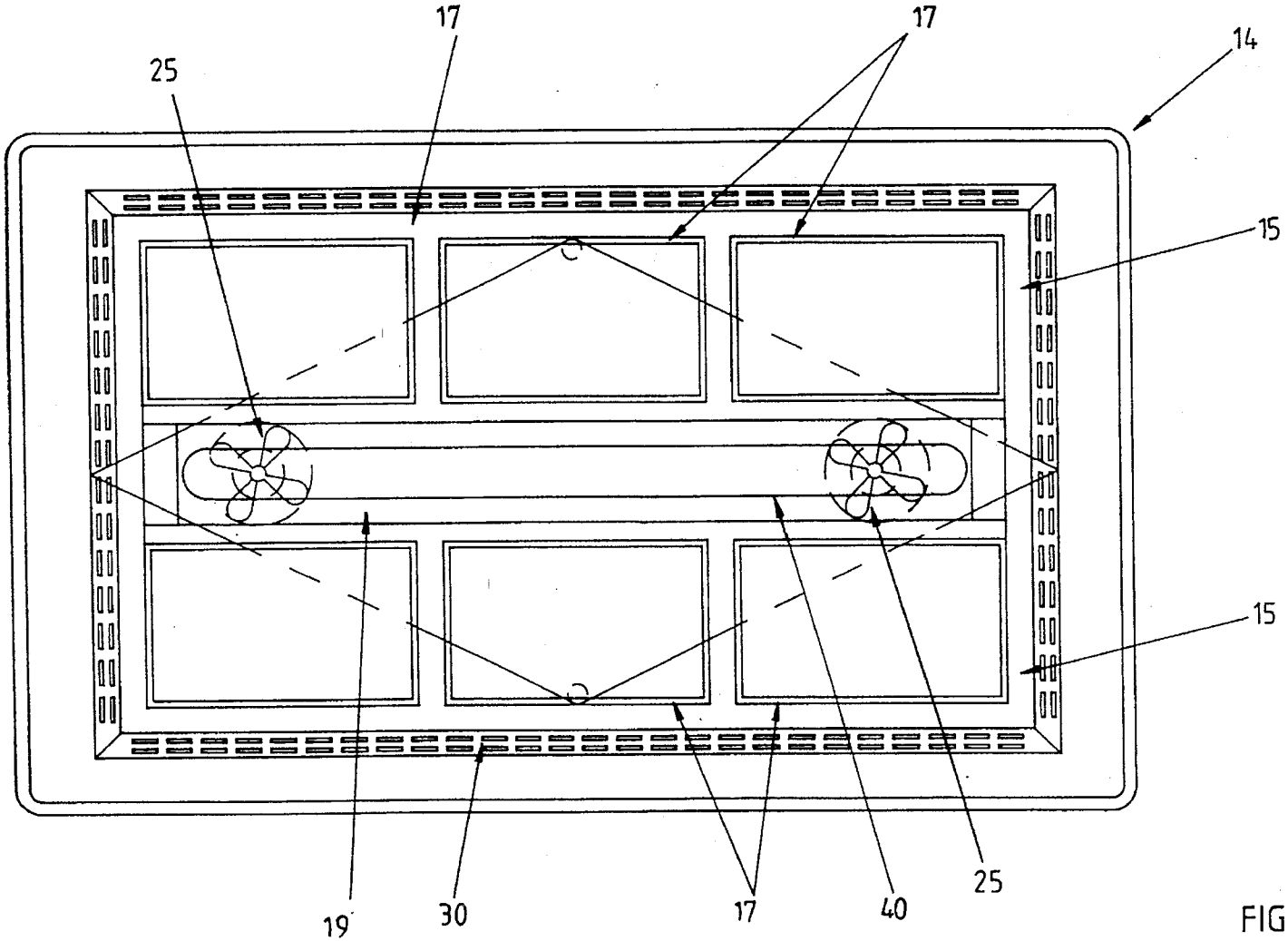
FIG. 2 is a schematic plan view of the unit of FIG. 1 showing the preferred location of the fans.
Figure 3:
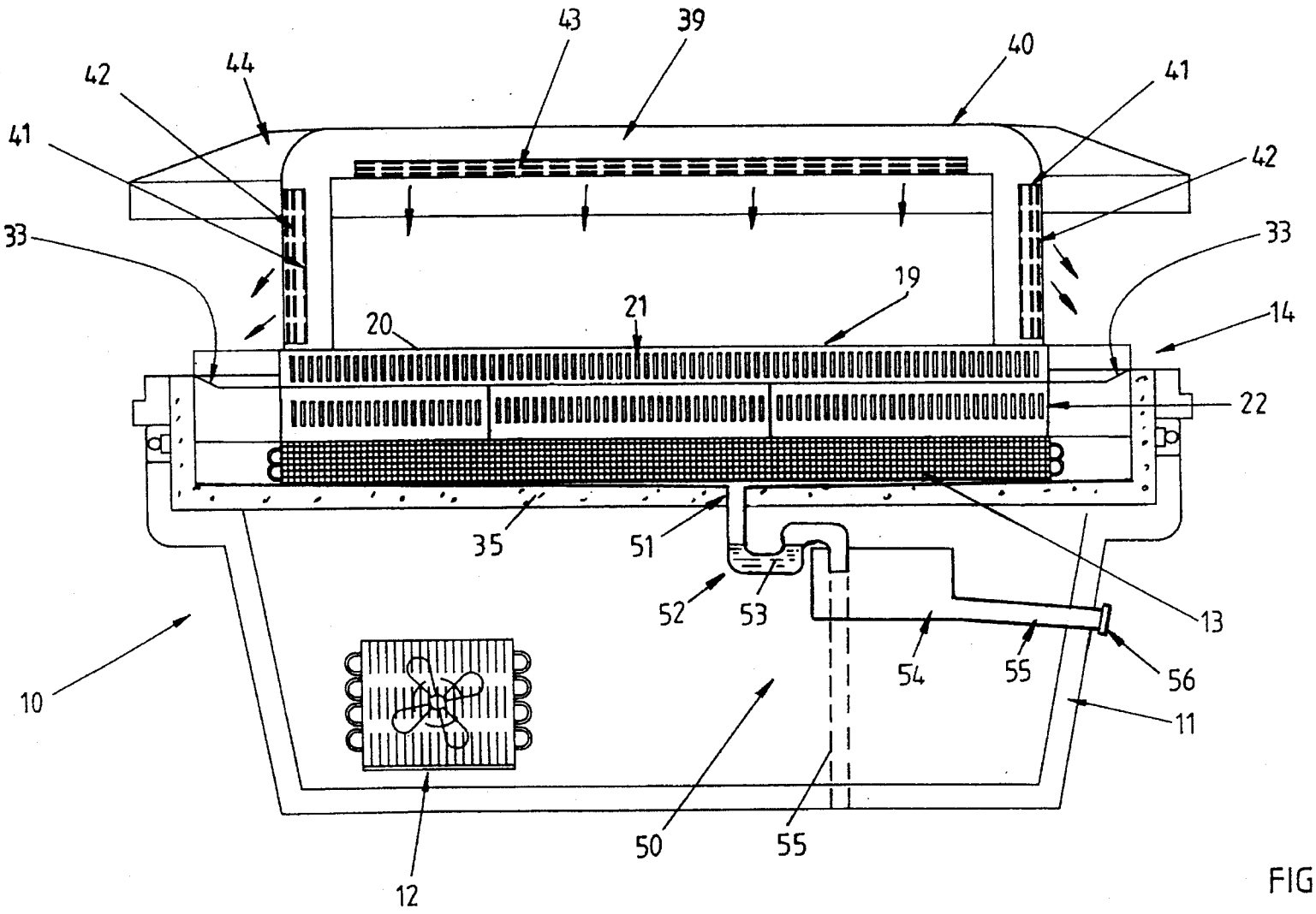
FIGS. 3 and 4 are partial cross-sectional views of the cabinet in the longitudinal and transverse directions.

Referring to the drawings and firstly to FIGS. 1 to 4 there is illustrated a refrigerated cabinet 10 according to one form of the present invention including a casing 11 which is normally supported on a ground or floor surface and which includes a refrigeration unit 12 associated with refrigeration coils 13. Supported on or formed with the casing 11 is a display and cooling unit 14 which in this embodiment includes a pair of spaced apart troughs 15 divided by transversely extending dividers 16, the troughs 15 being adapted to receive a number of pans or trays 17 in a single level on either side of the cabinet 10 for carrying food stuffs to be displayed and dispensed. As is conventional, the trays or pans 17 are provided with peripheral supporting flanges 18 to enable their support on upper edges of the troughs 15 and are removable to allow for emptying or refilling the contents of the trays 17. Extending longitudinally of the cabinet 10 and between the troughs 15 is a hollow elongated duct 19 of generally rectangular section form and having in its opposite side walls 20, upper and lower rows 21 and 22 of air outlets in this instance in the form of slots 23, the rows 21 and 22 being disposed above and below the trays 17 respectively. The duct 19 additionally incorporates a longitudinally extending horizontal dividing wall 24 (see FIG. 5) arranged below the lower rows 22 of slots 23. A pair of spaced apart fans 25 are supported on the wall 24 adjacent openings 26 through the wall 24 to draw air upwardly in the manner described further below. Further upright wall portions 27 are provided below or comprise extensions of the duct side walls 20 and include a longitudinally extending row 28 of openings or slots 29.

The cooling unit 14 at its opposite longitudinal sides is provided with air inlets in the form of longitudinally extending rows of slots 30 arranged adjacent the upper level of the trays 17. Further air outlet openings or slots 31 may also provided in opposite end walls 32 of the duct 19 and air inlets 33 may be provided at opposite ends of the cooling unit 14.

The opposite sets of refrigeration coils 13 are disposed beneath a horizontal wall 34 which is aligned with or comprises an extension of the wall 24 and which forms with an insulated base wall 35 of the cooling unit 14 opposite passages 36 in which the coils 13 are located. The air inlet openings 30 communicate with the lower side of the wall 34 and thus the passage 36 and coils 13 on their outer side whilst the coils 13 on their inner sides communicate with the duct 19 and the fans 25 through the slots 29 in the rows 28 and openings 26.

The duct 19 may be provided with a pair of opposite longitudinally extending baffles 37 (see FIG. 5) which separate the slots 23 in the upper rows 21 from direct communication with the fans 25. The baffles 37 are provided with a series of openings 38 which limit air flow to the slots 23 in the upper rows 21. This will ensure that the velocity of air #1owing outwardly of the slots 23 in the upper rows 21 is reduced and will undergo a tumbling action from the outlet slots 23 to the inlet slots 30 on the outer side of the cabinet 10.

Supported on the duct 19 is an overhead duct assembly 39 including an elongated generally horizontal overhead duct 40 spaced above and extending longitudinally of and generally parallel to the duct 19 and joining, or formed integrally at each end with upright ducts 41 which are mounted at spaced apart positions to the duct 19 adjacent the fans 25 and communicate with the interior of the duct 19.

The end ducts 41 are provided with a plurality of outlet openings 42 so as to direct cold air downwardly towards the inlet openings 33 provided at opposite ends of the unit 14. The central overhead duct 40 is provided with a series of openings 43 on its underside for directing air downwardly on both sides over the trays 17 and towards the inlets 30 on opposite sides of the unit 14, this air undergoing a generally tumbling motion.

In use and during operation of the fans 25 external air will be drawn in through the inlets 30 to pass through the refrigeration coils 13 to thus be cooled and be drawn into the duct 19 through the rows 28 of slots 29. The cooled or chilled air is then forced by the fans 25 out through the outlet slots 23 in the lower rows 22 to pass about the underside of the trays 17 and then be drawn back through the cooling coils 13 as indicated by the arrows in FIG. 4. The cool or chilled air is also forced out through the outlets 23 in the upper rows 21 (via the baffles 37 where used) to flow over the trays 17 in a tumbling manner to cool from the upper side and be drawn in through the inlets 30. Further chilled air is forced upwardly through the upright ducts 41 to pass out of the openings 42 and the overhead duct 40 to pass out through the openings 43 down towards the inlets 30 and 33 to create an air curtain to insulate the region about the tray 17 from the outside atmosphere. The entire products held within the trays 17 and thus encased in air whilst the trays 17 are subject to the cooling or chilling effect of the air flowing both above the trays 17 and below and around the trays 17.

The cabinet 10 is preferably provided with a canopy 44 arranged above the overhead duct 40 and extending on opposite sides and ends thereof to constrain the air flow in and around the trays 17. The canopy 44 is preferably formed of a transparent material such as perspex. Lighting elements 45 may be provided on opposite sides of the overhead duct 40 to extend longitudinally thereof for illumination of the trays 17 and their contents.

Figure 6:
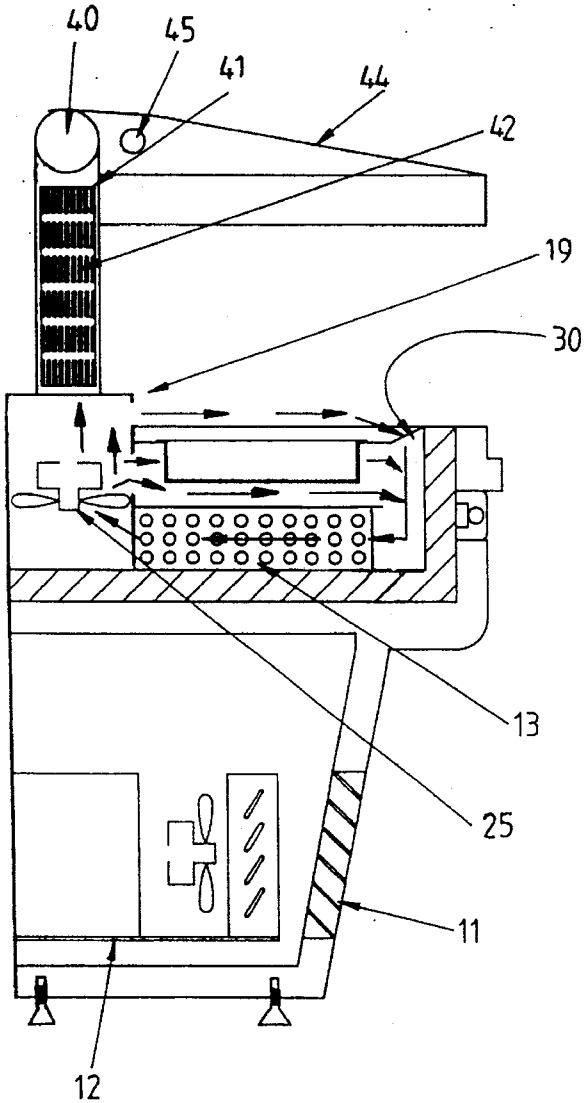
FIGS. 6 and 7 illustrate alternative forms of refrigerated cabinet according to the invention.

In an alternative version of the cabinet 10 of the invention as shown in FIG. 6, the overhead duct 40 may be provided to the rear of the cabinet 46 which effectively comprises half of the cabinet 10 to create an air curtain on one side only of the cabinet 46 which in this embodiment includes only a single row of trays 17. Of course, in this embodiment, or in the embodiment of FIGS. 1 to 4 more than one row of pans or trays 17 may be used.

In yet an alternative embodiment the overhead duct 40 may be extended either partially or fully around the perimeter of the unit 14 for example as at 47 to direct cold air downwardly towards the inlets 30 and 33 and create an air curtain about the periphery of the unit 14. In this arrangement the central overhead duct 40 may be eliminated.

Figure 4:
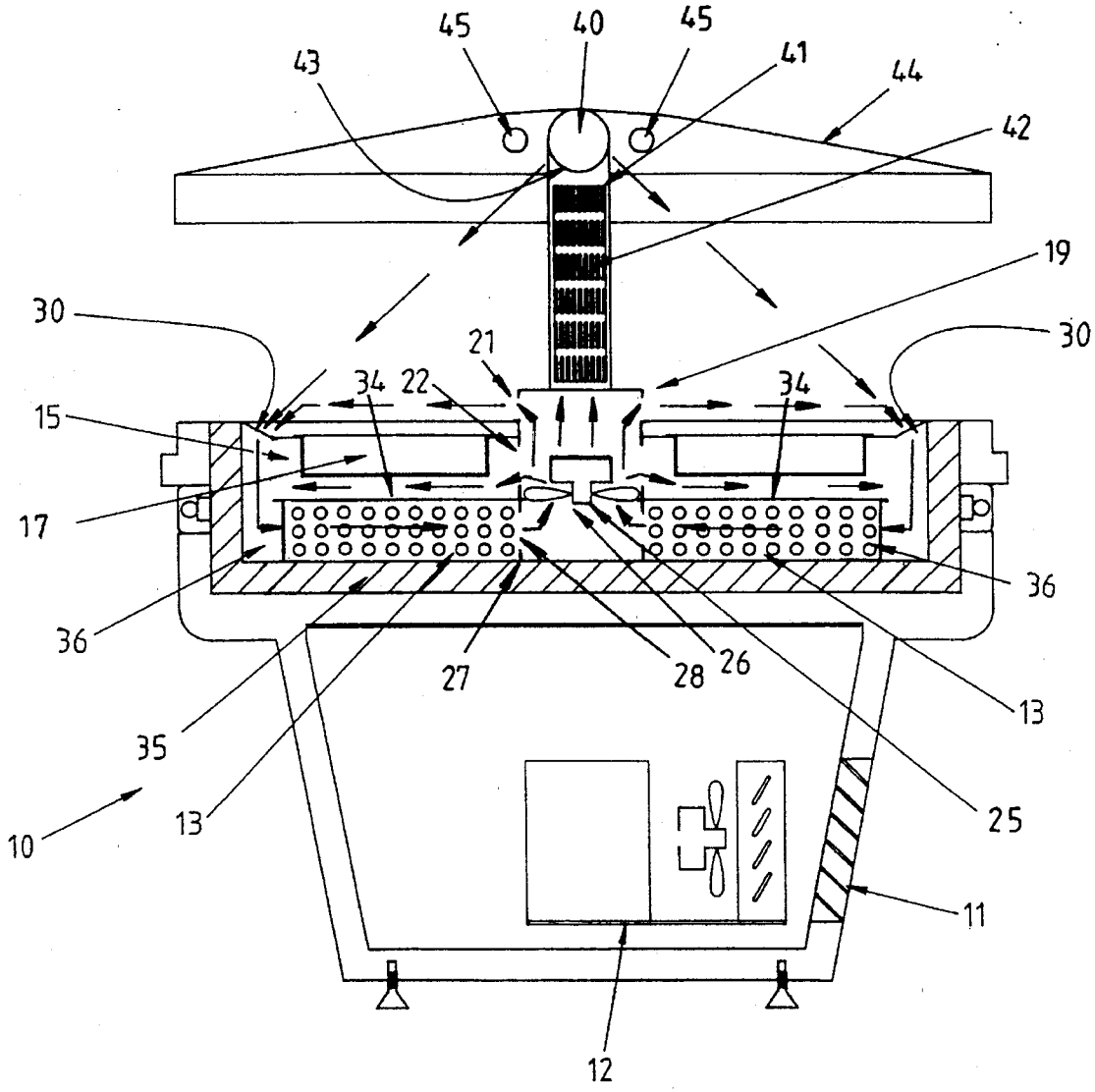
Figure 5:
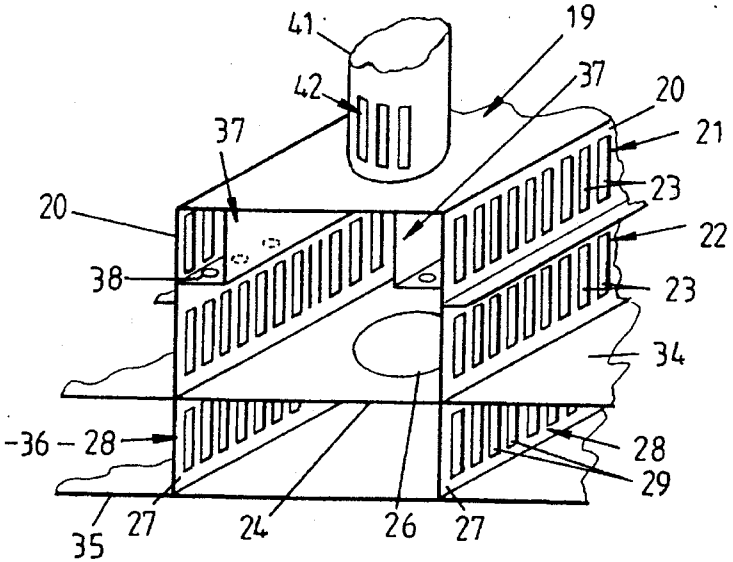
FIG. 5 illustrates portion of the central duct of the cabinet with fan removed.
Figure 7:
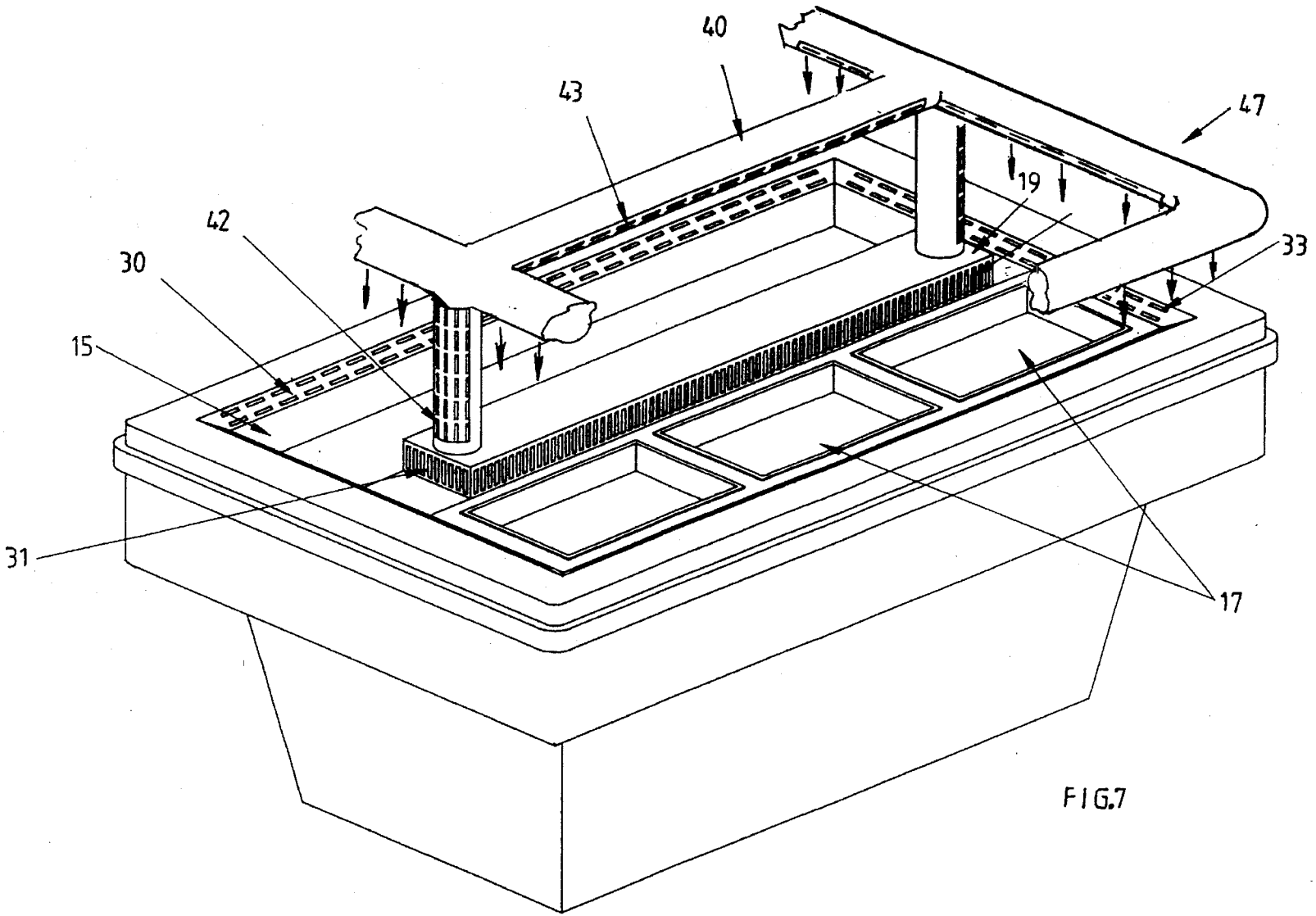

The outlet and inlet openings may be of any form such as slots, apertures or the like. In the embodiments illustrated, the openings are provided in rows. The inlet openings 30 and 33 are preferably arranged on an inclined angle directed upwardly as shown in FIG. 4 to improve air collection, however they may be in a horizontal plane. The inlet openings 30 and 33 are preferably in the form of slots.

In some embodiments the overhead duct assembly 39 is eliminated with the full chilling effect achieved in this instance by the cold air flow above and below the trays 17 as previously described.

A drain assembly 50 (see FIG. 3) is preferably provided in the cabinet 10 to drain condensed liquids or other substances from the cabinet 10 for cleaning purposes. The drain assembly 50 includes an inlet 51 which opens through the base wall 35 to receive liquid say which condenses along with other waste materials such as spilt food which collects beneath the trays 17. To direct such materials to the inlet 51 of the drain assembly 50, the base wall 35 may be inclined say by being creased from opposite sides and ends of the cabinet 14 towards the inlet 51. The inlet 51 is connected to a trap 52 in this embodiment in the form of a P-trap which forms a liquid seal 53. The outlet side of the trap 52 is directed into a holding tank 54 so that liquid and other materials passing through the inlet 51 are collected. The holding tank 54 is provided with an outlet duct 55 which extends to the outside of the cabinet and which is provided with a removable end cap 56.

In use, any liquid collecting on the base wall 35 of the cabinet 10 is directed towards the inlet 51 to pass through the trap 52 for collection in the tank 54. At the same time, air within the cabinet 10 which is usually hot air due to it being heated by the refrigeration unit 12 is prevented by the trap 52 and the liquid seal 53 therein from passing back up the inlet 51 into the chilling unit 14 of the cabinet. Thus cooling efficiency of the cabinet 10 is maintained.

For drainage purposes, the cap 56 is removed at regular intervals so that the contents of the tank 54 may be drained say into a bucket or the like for disposal. Additionally, a flushing or cleaning liquid when used to clean the cooling unit of the cabinet 10 is also directed by the base wall 35 to the inlet 51 into the holding tank 54 for drainage into a bucket or other similar container for discharge. At the end of the cleaning process, the cap 56 may be replaced so that liquids or other materials may again collect in the holding tank 54.

The drain assembly 50 described above has been shown in combination with a specific design of refrigerated cabinet. The drain assembly 50 however may be used with any form of refrigerated or other cabinet where drainage of condensed liquid and other materials and/or flushing liquids is required. The drainage assembly 50 may be incorporated at any position in a cabinet to collect condensed water or flushing liquids and of course depending upon the design of cabinet, more than one drainage assembly 50 may be provided. In some instances also, the holding tank 54 may be eliminated and the outlet of the trap 52 directed to an external drain such as a floor waste for example by a duct 55 (shown in dotted outline in FIG. 3).

The trays 17 for supporting the foodstuffs may be of any suitable form and in the embodiment illustrated of shallow dish-like form the trays 17, however, may have a deeper configuration or alternatively be in the form of a planar shallow body. The trays may also be fixed in position or formed integrally in the unit or cabinet. The trays are suitably formed of metal suitably stainless steel.

Whilst the above has been given by way of illustrative embodiment of the invention, all such modifications and variations thereto as would be apparent to persons skilled in the art are deemed to fall within the broad scope and ambit of the invention as herein defined in the appended claims.

We claim:

1. A refrigerated unit including supporting means for supporting foodstuffs or other products, means for establishing a first cool air flow above said supporting means from one side of said supporting means to the other side thereof to cool said foodstuffs or other products from above, means for establishing a second cool air flow on the underside of said supporting means whereby said supporting means is directly cooled by said second cool air flow, and overhead duct means located above said supporting means and including air outlet means, said overhead duct means being supported at each end by upright duct means which communicate with a source of cool air to supply said cool air to said overhead duct means whereby said cool air is directed through said air outlet means in said overhead duct means downwardly to provide an air curtain over said supporting means.

2. A unit according to claim 1 and including first air outlet means on said one side of said supporting means through which cool air for said first cool air flow passes and air inlet means on said other side of said supporting means for receiving air from said first air outlet means.

3. A unit according to claim 2 and including second air outlet means disposed below said first air outlet means for directing said second cool air flow to the underside of said supporting means.

4. A unit according to claim 3 and including air cooling means and there being provided circulating means for drawing air through said air cooling means and forcing cooled air through said first and second air outlet means.

5. A unit according to claim 4 wherein said air cooling means is arranged within a passage below said supporting means, said passage having a first end adjacent said air inlet means and a second end adjacent said circulating means such that air from said air inlet means is drawn through said air cooling means by said circulating means.

6. A unit according to claim 5 wherein said second cool air flow passes above said passage from said second air outlet means towards said first end of said passage such that air from said second cool air flow is drawn into said passage and through said air cooling means.

7. A unit according to claim 6 wherein said circulating means comprise one or more fans.

8. A refrigerated unit according to claim 2 wherein said overhead duct means includes a duct above said air inlet means.

9. A unit according to claim 4 and including elongated duct means adjacent said one side of said supporting means, said elongated duct means including said first and second air outlet means.

10. A unit according to claim 9 wherein said elongated duct means includes a side wall and wherein said air outlet means comprise openings in said side wall.

11. A unit according to claim 1 wherein said supporting means comprise open topped trays.

12. A unit according to claim 11 wherein said trays are provided in at least two rows and wherein said first and second cool air flows pass in opposite directions above and below said trays.

13. A refrigerated unit according to claim 1 and including a base wall below said supporting means and drain means connected through said base wall for draining liquids therefrom, said drain means including a liquid seal.

14. A unit according to claim 13 wherein said liquid seal is formed in a trap.

15. A unit according to claim 14 and including a holding tank for receiving liquid from said drain, said holding tank having an outlet arranged externally of said unit.

16. A cabinet according to claim 1 wherein said upright duct means include further air outlets for directing cool air outwardly to create air curtains at opposite ends of said cabinet.

17. A cabinet according to claim 1 and including a canopy above said overhead duct means for constraining air about said supporting means.

18. A refrigerated cabinet including means for supporting a row of open topped trays for holding foodstuffs or other products, air outlet means on one side of said supporting means, air inlet means on the opposite side of said supporting means, air cooling means, and air circulating means for drawing in air through said air inlet means and through said air cooling means for flow through said air outlet means, air flowing in use through said air outlet means passing above said trays towards said air inlet means and passing to the underside of said trays for direct cooling of said trays, elongated duct means extending generally parallel to said row of trays and including said air outlet means, said elongated duct means communicating with said air circulating means, and overhead duct means supported above said elongated duct means by upright duct means, said upright duct means communicating said overhead duct means with said elongated duct means whereby to receive cool air therefrom, said overhead duct means having air outlets for directing said cool air towards said air inlet means for forming an air curtain over said supporting means.

19. A cabinet according to claim 18 wherein said circulating means comprises one or more fans disposed below said air outlet means.

20. A cabinet according to claims 19 and including passage means arranged in use below said trays, said air cooling means being disposed in said passage means, said passage means having one end adjacent said air inlet means and the other end adjacent said fans such that air is drawn from said air inlet means through said cooling means.

21. A cabinet according to claim 19 wherein said upright duct means communicate with said elongated duct means adjacent respective said fans to receive cool air therefrom.

22. A refrigerated unit according to claim 18 wherein said overhead duct means includes a duct above said air inlet means.

23. A refrigerated cabinet including:

means supporting a substantially horizontal row of spaced apart open top shallow removable trays for holding foodstuffs or other products;

an elongated substantially horizontal duct arranged on one side of said row of trays, said elongated duct having upper and lower air outlets arranged therealong, said upper air outlets being disposed on the upper side of said trays and said lower air outlets being disposed on the lower side of said trays;

air inlets on the opposite side of said trays;

air chilling means;

fan means communicating with said elongated duct, and through said air chilling means with said air inlets;

whereby operation of said fan means draws in air through said air inlet means and said chilling means for chilling of said air and forces said chilled air into said elongated duct and through said air outlets for passage above and below said trays towards said air inlets whereby to chill said trays and the contents thereof; and an overhead duct extending substantially parallel to said elongated duct, upright ducts connecting said overhead duct with said elongated duct for supporting said overhead duct above said elongated cut and for receiving chilled air from said elongated duct for passage to said overhead duct, said overhead duct having further air outlets whereby chilled air passing through said further air outlets is directed towards said air inlets for creating an air curtain over said trays.

24. A refrigerated cabinet according to claim 23 wherein said fan means are located adjacent the connections of said upright ducts with said elongated duct.

25. A refrigerated unit according to claim 23 and including a further overhead duct above said air inlets, said further overhead duct having air outlets for directing chilled air towards said air inlet duct above said air inlet means.

26. A refrigerated cabinet including:

means supporting first and second spaced apart substantially horizontal rows of shallow open top removable trays for holding foodstuffs or other products;

an elongated substantially horizontal duct arranged between said first and second series of trays, said elongated duct having first and second sets of air outlets arranged therealong, said first set of air outlets being disposed on opposite sides of said elongated duct and on the upper side of said trays and said second set of outlets being disposed on opposite sides of said elongated cut and on the lower side of said trays;

air inlets on the outer side of said first and second series of trays;

air chilling means;

fan means communicating with said elongated duct, and through said air chilling means with said air inlets;

whereby operation of said fan means draws in air through said air inlets and said chilling means for chilling of said air and forces said chilled air into said elongated duct and through said first and second sets of air outlets for passage above and below said trays and towards said air inlets means whereby to chill said trays and the contents thereof; and an overhead duct supported above said elongated duct by upright ducts which communicate said overhead duct with said elongated duct, said overhead duct including further air outlets, said overhead duct receiving chilled air from said elongated duct for passage out of said further air outlets and flow towards said air inlets to form air curtains over said first and second series of trays.

27. A cabinet according to claim 26 wherein said upright ducts include further air outlets for directing cool air outwardly to create air curtains at opposite ends of said cabinet.

28. A refrigerated cabinet according to claim 26 and including a canopy above said overhead duct for constraining air about said trays.

29. A refrigerated unit according to claim 26 and including further overhead ducts above said air inlets, said further overhead ducts having air outlets for directing chilled air towards said air inlets.

30. A cabinet according to claims 18 wherein said air outlet means in said elongated duct means comprises first upper air outlets for air flow over said trays and second lower air outlets for air flow to the underside of said trays.

* * * * *